United States Patent [19]

Moe

[11] 3,949,889

[45] Apr. 13, 1976

[54] FRONT END LOADER

[75] Inventor: Richard G. Moe, LaPorte, Ind.

[73] Assignee: Allis-Chalmers Corporation, Milwaukee, Wis.

[22] Filed: Jan. 13, 1975

[21] Appl. No.: 540,721

[52] U.S. Cl. ..... 214/131 A; 172/272

[51] Int. Cl.[2] ..... E02F 3/72

[58] Field of Search ..... 214/131 A; 172/272, 275

[56] References Cited

UNITED STATES PATENTS

| | | | |
|---|---|---|---|
| 3,460,690 | 8/1969 | Seifert | 214/131 A |
| 3,554,396 | 1/1971 | Demkiw | 214/131 A |
| 3,612,311 | 10/1971 | Eidy et al. | 214/131 A |
| 3,863,786 | 2/1975 | Frank | 214/131 A |

FOREIGN PATENTS OR APPLICATIONS

| | | | |
|---|---|---|---|
| 1,924,269 | 11/1970 | Germany | 214/131 A |
| 1,240,195 | 7/1960 | France | 214/131 A |

*Primary Examiner*—Robert J. Spar
*Assistant Examiner*—Ross Weaver
*Attorney, Agent, or Firm*—Charles L. Schwab

[57] ABSTRACT

A front end loader attachment utilizing front and rear supports connected to the front and intermediate parts of a tractor to which a loader frame is detachably connected. The rear support is reinforced by a longitudinally extending truss structure connected to the drawbar mounting point beneath the rear of the tractor. A grill guard is pivotable from an upright position to a downwardly extending, inverted position in which it is capable of supporting the loader and loader frame when removed from the tractor. The loader frame has longitudinally extending braces which cooperatively engage a pair of coupling parts on the front support whereby the tractor and attachment are guidingly coupled as the tractor is driven forwardly into the loader frame as it rests on the inverted grill guard.

7 Claims, 6 Drawing Figures

FRONT END LOADER

BACKGROUND OF THE INVENTION

Heretofore, others have provided grill guards on the loader frame and the loader frame is pivotable relative to the booms of the loader sufficiently so that the loader frame may be utilized to support the rear of the loader attachment. Also, heretofore, others have provided cooperative guide means on the tractor and loader frame to assist in aligning the loader frame with the tractor as the tractor is driven forwardly for coupling engagement. Heretofore, it has also been suggested that the loader frame include members exending rearwardly to the rear axle of the tractor. These various features of the prior art are shown in U.S. Pat. Nos. 3,324,954; 3,460,690; 3,554,396; 3,610,450 and 3,833,136. A detachable grill guard is shown in my U.S. Pat. No. 3,622,174.

BRIEF DESCRIPTION OF THE INVENTION

A front end loader attachment includes a front support adapted for rigid connection to the front underside of the tractor which presents a pair of laterally spaced coupling parts adapted to engage complementary components formed on a loader frame. A rear support is adapted for rigid connection to an intermediate part of the tractor and includes transverse beam means supporting a pair of anchor members adapted for releasable connection with the loader frame. The rear support is reinforced by a longitudinally extending truss structure which is rigidly secured to the transverse beam means and extends rearwardly beneath the tractor where it is connected to the anchor point for the drawbar. A grill guard is pivotable from an upright position to a downwardly depending position in which it is capable of supporting the loader when the loader is detached from the tractor.

BRIEF DESCRIPTION OF THE DRAWINGS

The invention is incorporated in a front end loader attachment for a farm tractor as illustrated by the drawings in which.

DETAILED DESCRIPTION OF THE DRAWINGS

Figure 1:
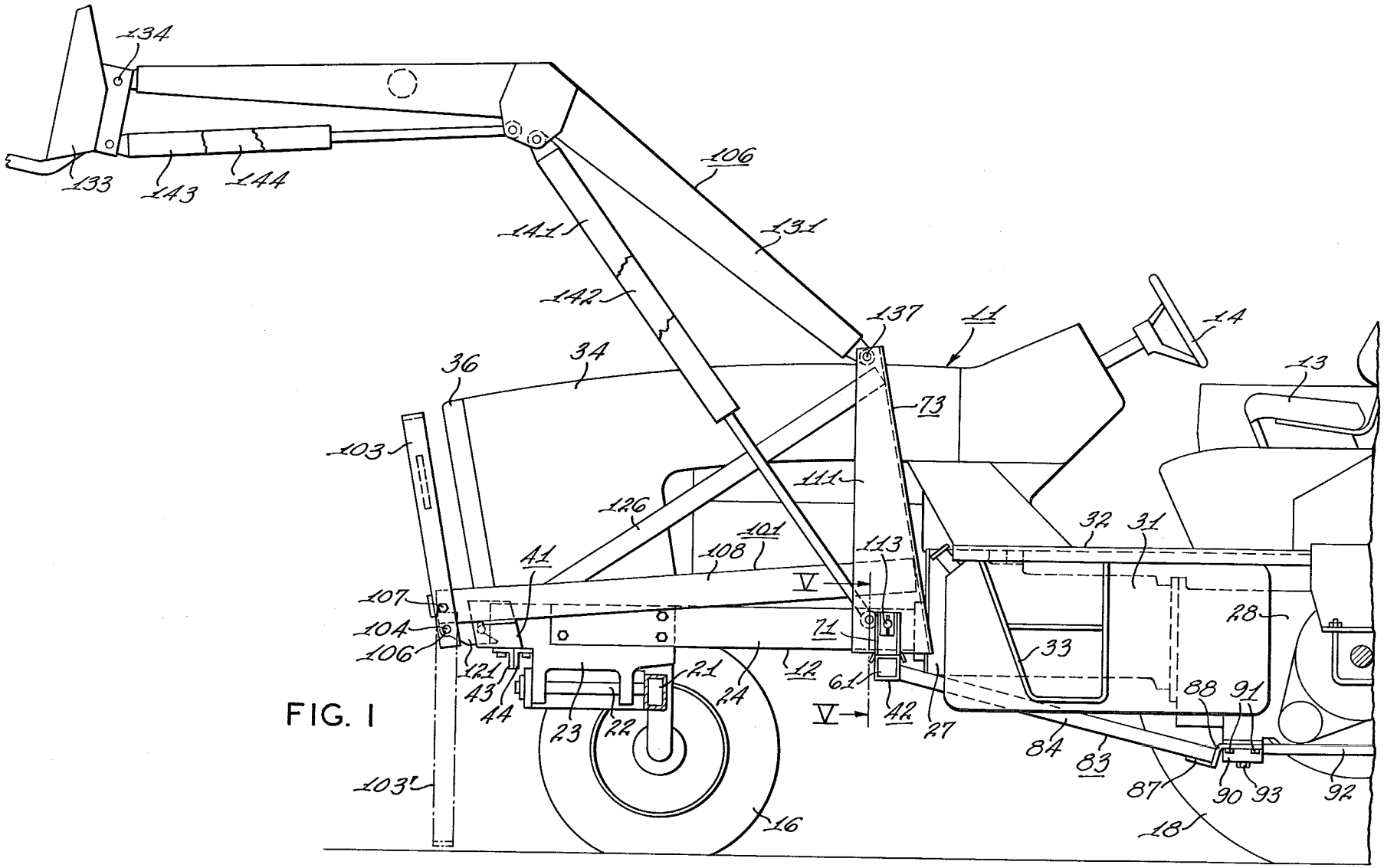
FIG. 1 is a side view of the loader attachment installed on a tractor with parts of the tractor broken away for illustration purposes.
Figure 2:
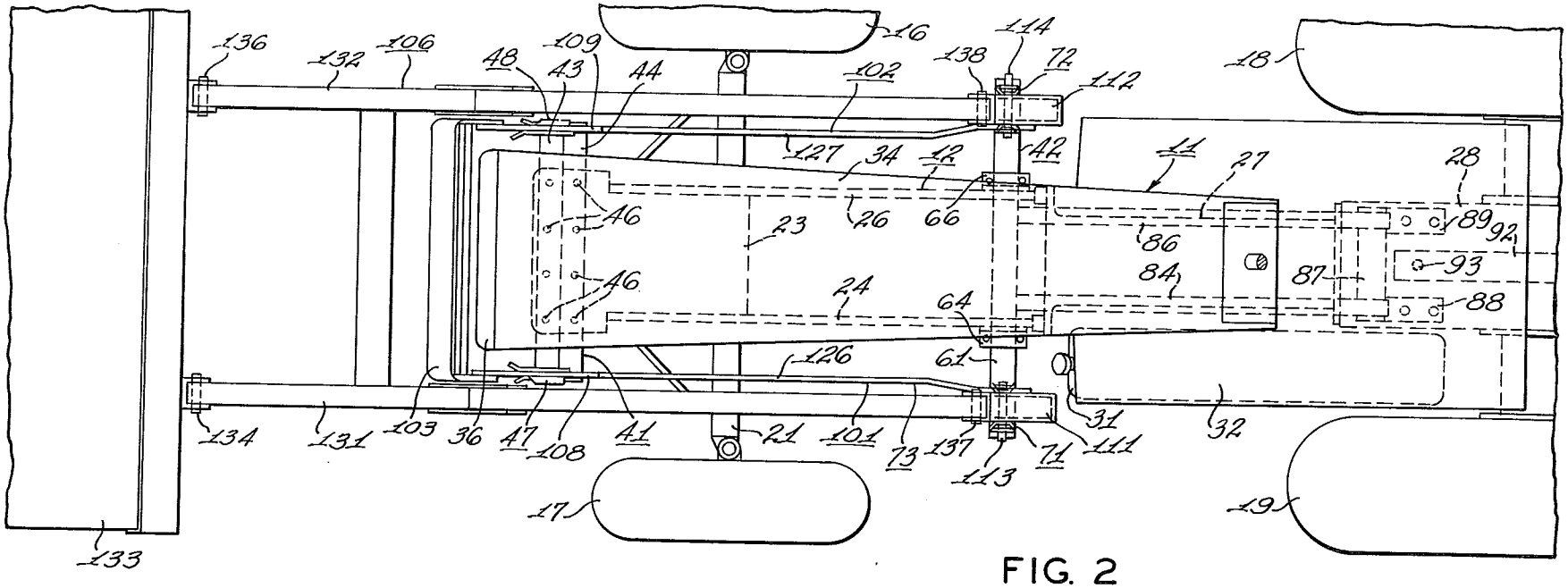
FIG. 2 is a top view of the loader attachment and tractor shown in FIG. 1.

Referring to FIGS. 1 and 2, the farm tractor 11 on which the loader attachment is installed includes a main frame 12, an operator's seat 13, a steering wheel 14, front steerable wheels 16, 17 and rear drive wheels 18, 19. The front wheels are mounted on an axle 21 pivotally connected by a central longitudinal pin 22 to a casting 23 which constitutes the front end of the main frame 12. The main frame includes a pair of longitudinally extending beams 24, 26 rigidly connected to the casting 23, a transmission housing 27 and a final drive housing 28 on which the drive wheels 18, 19 are rotatably mounted. A fuel tank 31 is suspended from an operator's platform 32 at the left side of the tractor and a suitable ladder 33 is provided for climbing on and off the tractor. A suitable engine and radiator are housed beneath the hood 34 of the tractor and the radiator is protected by a grill 36 at the front end of the hood.

Figure 4:
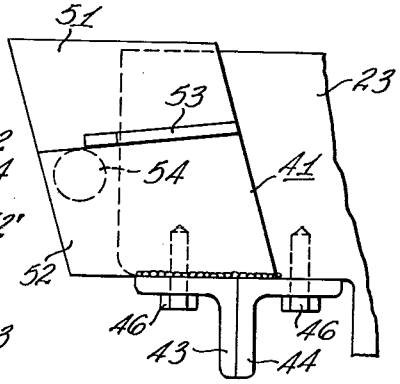
FIG. 4 is a side view of the front support shown in FIG. 3.
Figure 3:
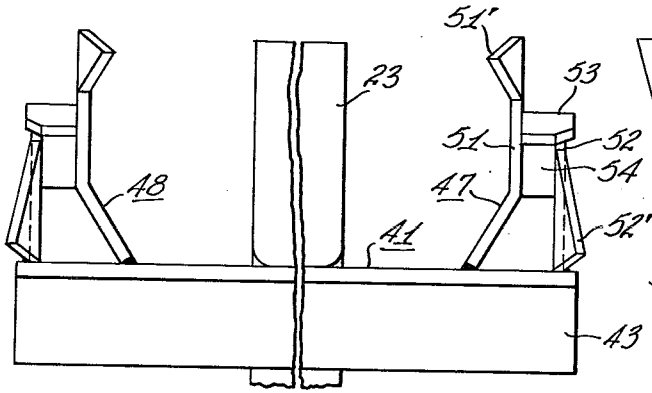
FIG. 3 is a view taken along the line III—III in FIG. 5 showing the front support.

In order to detachably support a loader frame, front and rear supports 41, 42 are provided which are rigidly secured to the front and intermediate parts of the tractor. The front support 41 includes a pair of side-by-side abutting angle members 43, 44 releasably secured to the under side of the casting 23 by a plurality of cap screws 46 and a pair of coupling parts 47, 48 which are shown in detail in FIGS. 3 and 4. The coupling part 47 includes a pair of laterally spaced upstanding plates 51, 52 which are welded to the top sides of the transverse angle members 43, 44. A slide plate 53 and cam pin 54 are welded to the plates 51, 52 and constitute functional portions of the coupling part 47. The front top portion 51′ of the laterally inner plate 51 is bent laterally inwardly and the front portion 52′ of the laterally outer plate 52 is bent laterally outwardly to assist in guiding the loader frame into coupling position when the tractor is driven forward to connect the loader frame. The coupling part 48 is a reverse image of coupling part 47.

Figures 5, 6:
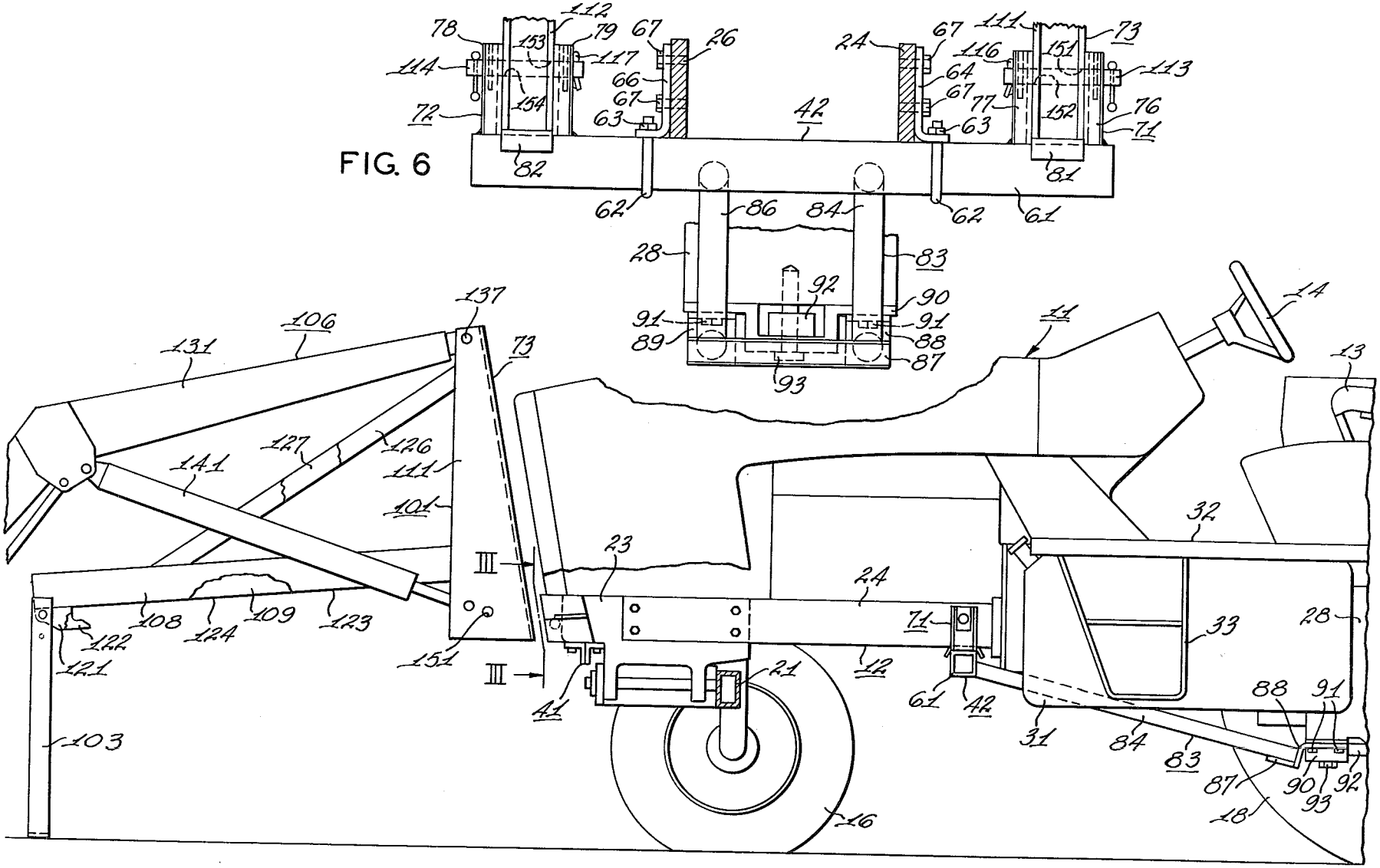
FIG. 5 is a side view similar to FIG. 1 but showing the loader and its frame detached from the tractor.
FIG. 6 is a section view taken along the line V—V in FIG. 1.

Referring also to FIG. 6, the rear support 42 includes transverse beam means in the form of a hollow section beam 61, which is fixedly secured to the longitudinal main frame beams 24, 26 by U-bolts 62 secured by nuts 63 to angles 64, 66. The angles 64, 66 are, in turn, releasably secured to beams 24, 26 by cap screws 67. A pair of anchor members 71, 72 are secured to transversely opposite ends of the transverse beam 61 to support the rear of the loader frame 73. Anchor member 71 includes a pair of laterally spaced upright channels 76, 77 welded at their lower ends to the top of the transverse beam 61 and a guide plate 81 which is welded to channels 76, 77. A pair of upstanding channels 78, 79 and guide plate 82 similarly constitute the anchor member 72. The transverse beam 61 is longitudinally braced by a truss structure 83 including a pair of laterally spaced and longitudinally extending braces 84, 86 welded at their front ends to the transverse beam 61 at points spaced laterally inwardly from the anchor members 71, 72. The truss structure 83 also includes a transverse plate 87 welded to the rear ends of the braces 84, 86 and a pair of mounting plates 88, 89 welded to the rear ends of braces 84, 86 which are releasably secured to the drawbar hitch portion 90 of the final drive housing by cap screws 91 which threadably engage drilled and tapped holes in the final drive housing 28. As shown in FIGS. 1, 5 and 6, a drawbar member 92 is connected at its forward end to the hitch portion 90 by a cap screw 93.

The loader frame 73 includes a pair of laterally spaced and longitudinally extending side frames 101, 102 and a grill guard 103 pivotably connected at the front end of the side frames 101, 102 on a transverse pivot axis 104 by a pair of pivot pins 106, only one of which is shown. The grill guard 103 is held in its upright position by releasable fastening means in the form of a pair of cap screws 107, only one of which is shown, which threadedly engage drilled and tapped openings in the front ends of a pair of forwardly extending braces 108, 109 of the side frames 101, 102. The grill guard may be pivoted forwardly and downwardly to its inverted position shown in dash lines 103' when the loader 106 is raised. In the inverted position 103', the guard serves to support the loader 106 and the loader frame 73 when the latter is detached from the front and rear supports 41, 42 on the tractor. The side frames 101, 102 include a pair of upstanding boom support members in the form of towers 111, 112 which are releasably attached at their lower ends to the anchors 71, 72 by a pair of pins 113, 114, which are releasably held in their installed condition by cotter pins 116, 117. The braces 108, 109 have hooklike coupling components 121, 122 welded to the underside of their front ends which cooperatively engage the coupling parts 47, 48, as shown in FIG. 1. The braces 108, 109 extend rearwardly at a slight upward inclination and present downwardly facing slide surfaces 123, 124 on their bottom side which slidingly and guidingly engage the slide plates of the coupling parts 47, 48 when the tractor is driven forwardly to couple the loader frame 73 to the supports 41, 42. The rear of the braces 108, 109 are welded to the laterally inner sides of the towers 111, 112 and a pair of diagonal braces 126, 127 are welded at their front ends to the braces 108, 109 and are welded at their rear ends to the laterally inner sides of the towers 111, 112, thus reinforcing the latter.

The loader 106 includes a pair of longitudinally extending booms 131, 132, and a fork attachment 133 pivotably mounted on the front ends of the booms by aligned transverse pivot pins 134, 136. The rear ends of the booms 131, 132 are pivotably connected to the towers 111, 112 of the side frames 101, 102 by a pair of transverse pivot pins 137, 138 and the booms 131, 132 are raised and lowered by a pair of double acting hydraulic jacks 141, 142 interconnected between the booms and the lower ends of the towers 111, 112. The fork attachment 133 is tilted by a pair of double acting jacks 143, 144 interconnected between the booms and lower rear of the fork attachment.

Referring to FIG. 5, the loader 106 and the loader frame 101 are resting on the fork attachment and the grill guard 103 and the support structure comprising the supports 41, 42 and truss structure 83 are shown secured to the tractor 11. As the tractor 11 is driven forwardly, the coupling parts 47, 48 will slidingly engage the slide surfaces 123, 124 on the underside of the side frame braces 108, 109 and the cylindrical pins of the coupling parts 47, 48 will engage the coupling components 121, 122. The lift jacks 141, 142, which are connected to a fluid supply and control system, not shown, on the tractor, are actuated to align the transverse openings 151, 152, 153, 154 in the towers 111, 112 with the openings provided in the channels 76, 77, 78, 79 for the pins 113, 114. The pins 113, 114 are then installed as shown in FIGS. 2 and 6. The loader is then raised and the grill guard 103 is pivoted upwardly to permit the cap screws 107 to be installed to hold the guard in its upright position.

In summary, the grill guard 103 serves a double function of protective device for the grill 36 and stand for supporting the loader and loader frame in a position permitting drive-in tractor coupling and attachment of the loader frame to the loader supports on the tractor. The reinforcing truss is disposed laterally inwardly of the fuel tank and thus avoids interference with the operator's access to the operator platform by way of ladder 33. Use of the drawbar mounting for connecting the rear end of the truss structure saves the expense of providing a separate mounting point.

The embodiments of the invention in which an exclusive property or privilege is claimed are defined as follows:

1. A front end loader attachment for a tractor comprising:

a support structure including a front support adapted for rigid connection to the front of a tractor including a pair of laterally spaced coupling parts, and a rear support including a transverse beam adapted to extend beneath and to be connected to an intermediate pair of the main frame of said tractor and having transversely opposite ends adapted for connection to and support of a loader frame said ends being disposed outwardly from opposite sides of said tractor when said support is installed thereon and a longitudinally extending truss structure rigidly secured at its front end to that part of said transverse beam that is beneath said main frame of said tractor when said support is installed thereon and adapted at its rear end for connection to the underside of the final drive housing of said tractor at the point where the drawbar is attached, a loader frame including a pair of laterally spaced and longitudinally extending side frames releasably attached at their lower rear ends to said opposite ends, respectively, of said beam and having coupling components at their forward ends in cooperative emgagement with said coupling parts, respectively, and a pair of upstanding boom support members, and a loader having a pair of longitudinally extending booms pivotably attached at their rear ends to said boom support members.

2. The attachment of claim 1 and further comprising a grill guard pivotably connected at its lower end to the front end of said side frames on a transverse pivot axis and releasable fastening means securing said guard to said side frames maintaining said guard in a substantially upright position, said grill guard being pivotable downward to a substantially inverted position upon release of said fastening means whereby said guard is operable to support said loader and loader frame when the latter is detached from said tractor.

3. The attachment of claim 1 wherein said side frames present downwardly facing slide surfaces which guidingly and slidingly engage said front support when said tractor is driven forwardly to couple the loader frame to said supports.

4. The attachment of claim 3 wherein said slide surfaces engage said coupling parts.

5. The attachment of claim 4 wherein said front support includes a transverse member adapted for releasable connection to the underside of the front end of said tractor.

6. The attachment of claim 1 wherein said truss structure includes a pair of longitudinally extending and laterally spaced braces ridigly secured at their forward ends to said transverse beam.

7. The attachment of claim 1 and further comprising a grill guard pivotably connected to the front ends of said side frames adajcent said coupling components for swinging movement about a transverse axis between a substantially upright position to a downwardly extending inverted position, said grill guard being operable to support said loader and loader frame in its inverted position, and fastening means releasably securing said grill guard to said side frame in its upright position.

* * * * *

UNITED STATES PATENT OFFICE

CERTIFICATE OF CORRECTION

Patent No. 3,949,889 Dated April 13, 1976

Inventor(s) Richard G. Moe

It is certified that error appears in the above-identified patent and that said Letters Patent are hereby corrected as shown below:

Column 4, line 14, "pair" should read --- part --- ;
line 34, "emgagement" should read --- engagement --- .

Signed and Sealed this

Thirty-first Day of August 1976

[SEAL]

*Attest:*

RUTH C. MASON
*Attesting Officer*

C. MARSHALL DANN
*Commissioner of Patents and Trademarks*